US006481867B2

(12) United States Patent
Ewing

(10) Patent No.: US 6,481,867 B2
(45) Date of Patent: Nov. 19, 2002

(54) MODULAR LUMINAIRE ASSEMBLY

(75) Inventor: Robert L. Ewing, Newark, OH (US)

(73) Assignee: Acuity Brands, Inc., Atlanta, GA (US)

( * ) Notice: Subject to any disclaimer, the term of this patent is extended or adjusted under 35 U.S.C. 154(b) by 0 days.

(21) Appl. No.: 09/803,507

(22) Filed: Mar. 9, 2001

(65) Prior Publication Data

US 2002/0126477 A1 Sep. 12, 2002

(51) Int. Cl.[7] ..... F21S 1/17

(52) U.S. Cl. ..... 362/226; 362/370; 362/371; 362/431; 362/265

(58) Field of Search ..... 362/221, 217, 362/365, 374, 375, 265, 431, 226, 370, 371

(56) References Cited

U.S. PATENT DOCUMENTS 4,538,217 A * 8/1985 Ewing et al. ..... 362/220
4,791,539 A * 12/1988 Ewing ..... 362/226
5,803,590 A * 9/1998 Wedell et al. ..... 362/226

* cited by examiner

*Primary Examiner*—Sandra O'Shea
*Assistant Examiner*—John Anthony Ward
(74) *Attorney, Agent, or Firm*—Kenneth E. Darnell

(57) ABSTRACT

A modular mounting-arm assembly for use with a luminaire, the modular mounting assembly including a housing and a removable access door hingedly affixable to the housing for receiving and supporting an electrical assembly. The electrical assembly comprises electrical components having electrical connections which terminate in a mounting arm quick disconnect.

16 Claims, 5 Drawing Sheets

MODULAR LUMINAIRE ASSEMBLY

TECHNICAL FIELD

This invention relates to a mounting-arm assembly which is particularly suited for outdoor luminaire assemblies and more specifically to a mounting arm assembly having an easily removable electrical subassembly.

BACKGROUND ART

Luminaire assemblies typically include a housing for enclosing and protecting electrical components required for operation of a luminaire. The optical assembly is generally comprised of a lighting unit such as a high intensity discharge (HID), high pressure sodium (HPS), or other illumination means as well as refractor and reflector assemblies for producing and directing light of various intensities. These assemblies require space in the luminaire for the electrical components as well as space to complete the necessary wiring. By necessity, most luminaire assemblies are, therefore, large in size and, in many instances, not aesthetically pleasing.

Mounting arms have heretofore been designed to provide compartments for electrical components. Such designs, however, have resulted in increased installation and maintenance costs because of the minimal flexibility afforded by the corresponding mechanical design. For example, in high pressure sodium systems, the electrical components, namely ballasts, capacitors, and starters, require routine maintenance. Similarly, the wattage characteristics, voltage characteristics, or both, may require adjustment to provide the required amount of illumination as well as to conserve energy. These maintenance procedures typically include the disassembly of what is oftentimes heavy and awkward parts as well as the removal, splicing and reconnection of corresponding electrical wires. Because the direct wire design of such prior art systems, the corresponding maintenance procedures must also be performed onsite. Alternatively, the luminaire may be temporarily disabled so that the particular component can be repaired in a remote laboratory or factory.

The maintenance procedures referenced above are, of course, further hindered during adverse weather conditions such as, for example, heavy wind, rain, and snow. Extreme temperature gradients similarly make the maintenance procedures more difficult and uncomfortable for the maintenance engineer. These complications inherent in the prior art mounting arm assembly designs have resulted in increased labor and maintenance costs which, in turn, have caused purchasers and designers to turn their attention toward viable design alternatives.

U.S. Pat. No. 5,351,174 to the Holophane Lighting, Inc. discloses a modular luminaire assembly including a top mounting assembly, an optical assembly removably affixable to the top mounting assembly and an electrical assembly. The electrical assembly is removably affixable to the optical assembly where the optical assembly is mechanically coupled to the top mounting assembly by a quick disconnect.

U.S. Pat. No. 5,243,508 to Holophane Company, Inc. discloses a modular luminaire assembly for receiving assorted optical assemblies and assorted electrical assemblies. The modular luminaire assembly includes a base unit having an opening on one side and a platform for receiving and supporting a selected optical assembly and a removable panel assembly mountable within the opening. The panel assembly is adapted to received and support a selected electrical assembly. The base unit, optical assembly and panel assembly form respective first, second, and third unitary modules.

Consequently, a need exists for an improved mounting arm assembly for use in an outdoor luminaire which obviates the above-mentioned problems. Such an improved mounting arm assembly should, therefore, be easy to install and maintain regardless of the attendant weather conditions and experience of the service technician.

DISCLOSURE OF INVENTION

It is an object of the present invention to provide an improved mounting arm assembly for use in an outdoor luminaire which is readily and quickly accessible by service technicians.

It is further an object of the present invention to provide an improved mounting arm assembly which is modular and adapted to receive and support an electrical assembly, the electrical components of which may be readily repaired, replaced, and adjusted on-site.

It is yet another object of the present invention to provide a modular mounting assembly including an optical mounting assembly for use in connecting the optical unit to the mounting arm where the modular mounting assembly includes a swivel assembly capable of providing a leveling action in a range from 0 to 3.5 degrees.

It is still yet another object of the present invention to provide a modular mounting assembly including an optical mounting assembly for use in connecting the optical unit to the mounting arm where the modular mounting assembly includes a swivel assembly capable of providing a leveling action the swivel assembly including a swivel nipple, a set screw base, a wiring ring and at least one set screw.

In carrying out the above objects and other objects, features and advantages of the present invention, there is provided a modular mounting arm assembly for use in an outdoor luminaire. The mounting arm assembly includes a housing and a removable access door affixable to the housing. The assembly further includes a mounting plate affixable to the access door for receiving and supporting an electrical assembly.

In a preferred embodiment, the access door is hingedly affixable to the housing and the mounting plate is affixable to an inside surface of the access door for receiving and supporting electrical components within an internal cavity. The electrical components which include, for example, a ballast, a starter, and a capacitor terminate in one or more corresponding quick disconnects.

In carrying out further objects of the present invention, there is provided a luminaire assembly for outdoor lighting including a optical assembly, a modular mounting-arm assembly affixable to the optical assembly, the modular mounting assembly including a housing and a removable access door affixable to the housing for receiving and supporting an electrical assembly The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
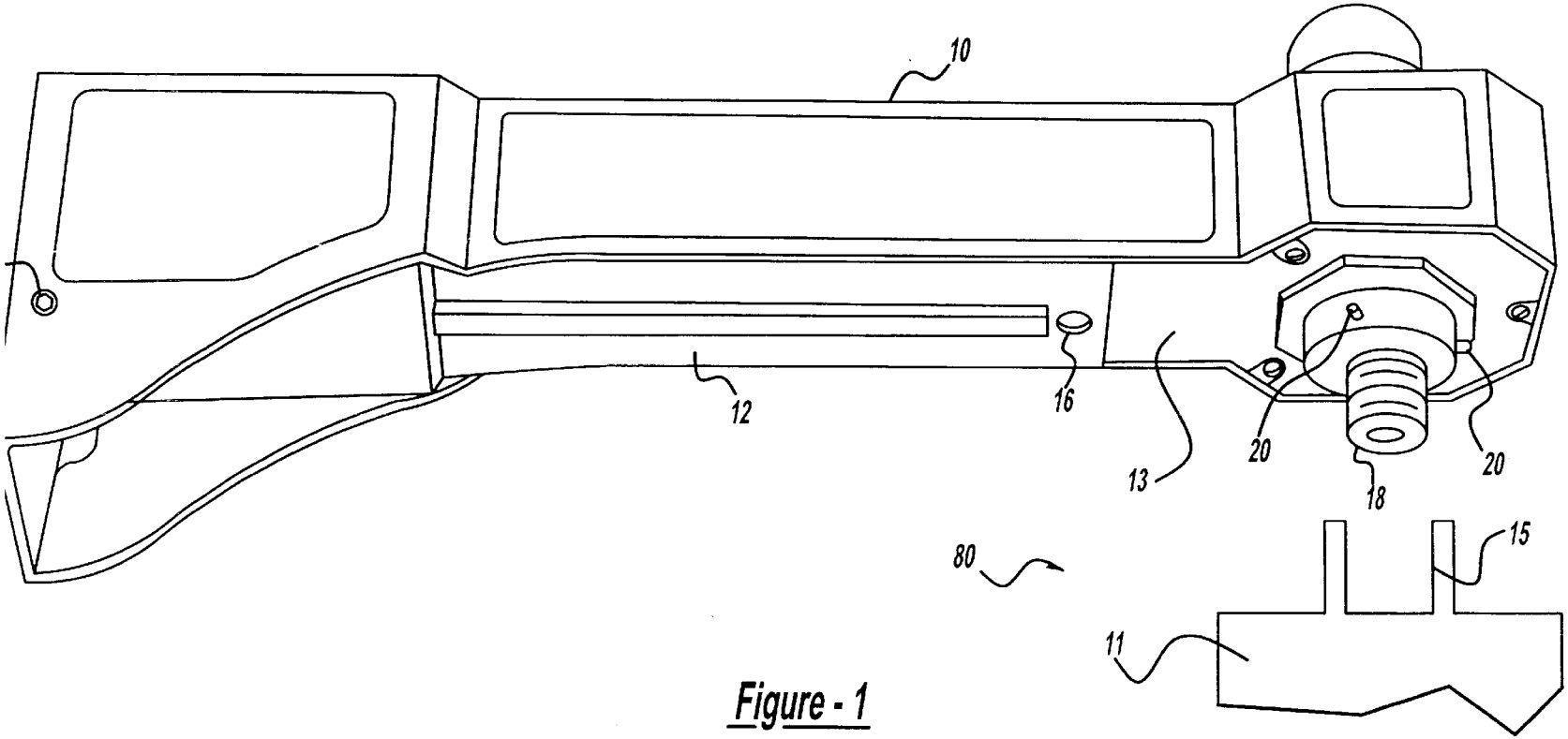
FIG. 1 is a perspective view of the modular mounting arm assembly of the present invention.

With reference to FIG. 1 in the drawings, they are shown in a perspective view of a modular mounting arm assembly of the present invention designated generally by reference 10. Mounting arm 10 is adapted to be affixed to a stanchion such as a street pole, or the like (not shown). Mounting arm 10 is also configured to receive a luminaire 11 (only partially shown). A removable access door 12 is affixable to one side of mounting arm housing 13 of mounting arm 10. In a preferred embodiment, the access door 12 is hingedly affixable to mounting arm housing 13 via one or more fasteners 14 and secured in a closed position with fastening means 16 such as a wingnut.

Still referring to FIG. 1 of the drawings, luminaire 11 includes an optical assembly 15 which may be attached to mounting arm 10 through appropriate fastening means such as swivel nipple assembly 18 using set screws 20. The optical assembly 15 is generally comprised of a lighting unit and a refractor (not shown) for producing and directing light of various intensities. As can be seen from FIG. 1, the mounting arm 10 is sleek and efficient in design while still affording a fully functional mounting arm for attaching the optical assembly 15.

Figure 2:
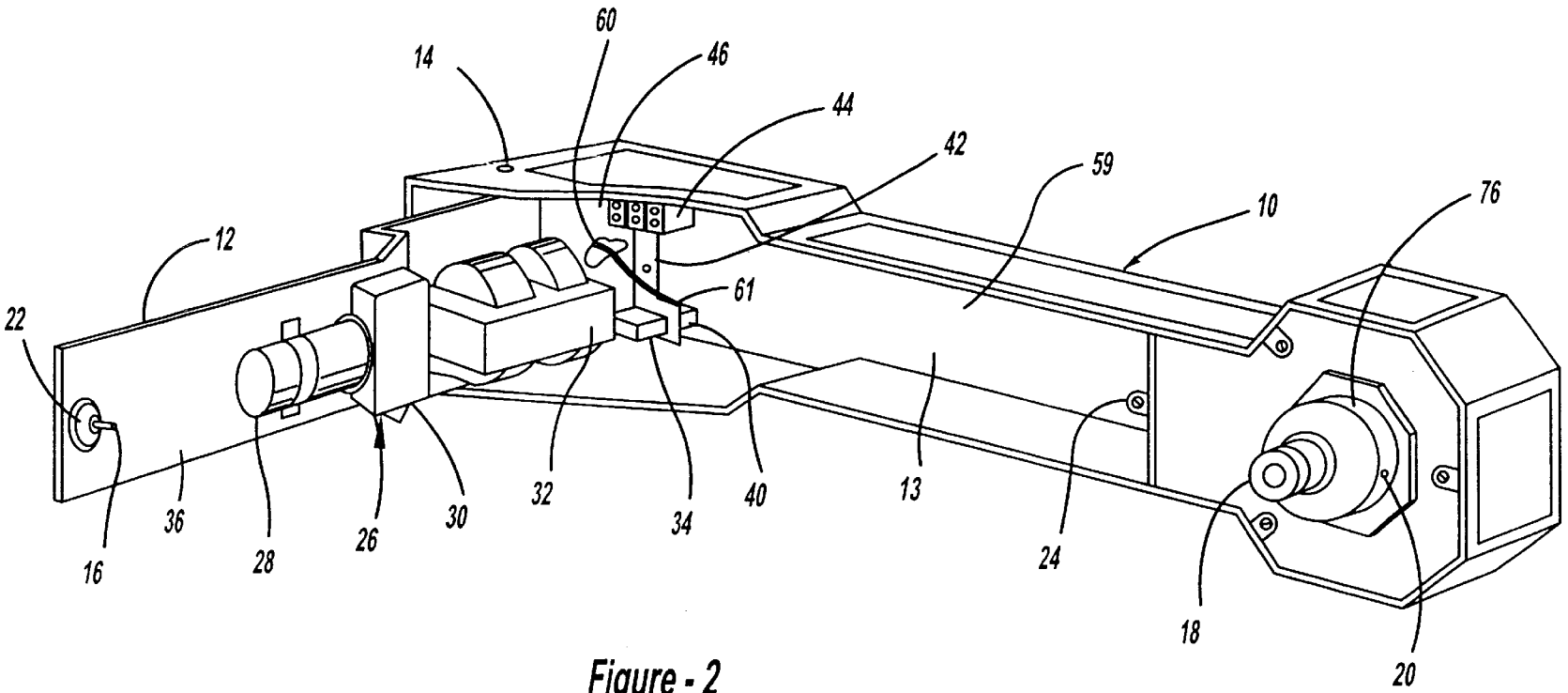
FIG. 2 is a perspective view of the modular mounting arm assembly of the present invention illustrating the removable access door in an open position.

Referring now to FIG. 2 of the drawings, mounting arm 10 is shown with access door 12 in an open position. Access door 12 is fully functional and is openable to a ninety (90) degree angle from mounting arm housing 13. This degree of operation with the ninety degree (90) angle allows for complete access to an electrical assembly 26 as described more filly below. As shown, access door 12, in a preferred embodiment, is hinged about one or more screws 14. Any means of hingedly fastening the access door 12 to the mounting arm housing 13 is contemplated by the present invention. A fastener means such as wing fastener 16 is used to lock the access 12 to the mounting arm housing 13. More specifically, the wing fastener 16 extends through access door 12 and contacts washer 22. In this fashion, wing fastener or wingnut 16 engages with threaded boss 24 as part of mounting arm housing 13. A tightening of wingnut 16 into threaded boss 24 effectively closes and locks the access door 12 with the mounting arm housing 13.

Any form of fastening the access door 12 to the mounting arm housing 13, such as a nut and bolt or screw means is contemplated by the present invention. The fastening means must effectively close and lock the access door 12 to the mounting arm housing 13 while allowing for a quick simple disengagement off the door 12 from the housing 13 during maintenance as discussed below. As technicians may be conducting maintenance activities on the mounting arm 10 or access door 12 while the luminaire is in operation, the luminaire will most likely be in an overhead or extended position. Utilization of a mounting arm 10 and access door 12 combination which affords the technician ease of engagement and disengagement, for instance while the technician is located on a ladder or some form of extension, is a useful advantage.

Also attached to access door 12 is an electrical assembly 26 comprising electrical components such as a starter 28, a capacitor 30, a ballast 32, and an electrical disconnect 34. The above description of an electrical assembly having electrical components such as a starter 28, a capacitor 30, a ballast 32, and an electrical disconnect 34 is for example only and other combinations and forms of electrical components for use with a luminaire are envisioned by the present invention. While the electrical components which comprise electrical assembly 26 may be affixed directly to the inside surface of access door 12, it is, of course, anticipated that a separate mounting plate may be affixed to the inside surface 36 of access door 12 on which one or more of the electrical components may be affixable. In an alternative embodiment of the present invention, utilization of a separate mounting plate affords a different method of manufacturing and maintenance flexibility in making quick changes to the electrical assembly 26. The use of a mounting plate, after the access door is opened and removed, allows for an exchange of one mounting plate including an electrical assembly 26 with another.

According to the best mode of the present invention, to remove or replace the entire access door 12, a service technician need only unplug electrical disconnect 34 from electrical disconnect receptacle 40 and then remove the corresponding screws 14 which act as hinge points. Inside mounting arm 10 there is further attached to a strap 42 an electrical terminal block 44 and the housing quick disconnect or electrical disconnect receptacle 40. A service wire 46 is attached to 10 the electrical terminal block 44. In one embodiment of the present invention, the housing quick disconnect 40 is connected to the electrical supply wiring set 61. Electrical assembly 26 therefor may comprise electrical components such as a starter 28, a capacitor 30, a ballast 32, which includes electrical connections which terminate in the electrical disconnect or mounting arm quick disconnect 34.

As readily seen, when access door 12 is in a closed position, the electrical components mounted thereon are kept dry and protected from the outdoor elements as well as tampering. More specifically, when removable access door 12 is closed it defines a sealed internal cavity 59 within the housing 11 such that the sealed internal cavity protects the electrical assembly 26 from certain detrimental environmental conditions. As a result of this configuration, the modular design of the improved mounting arm of the present invention results in reduced service and maintenance time given that the electrical components on the access door 12 are easily accessible and no hardwiring or splicing are required.

Figure 4:
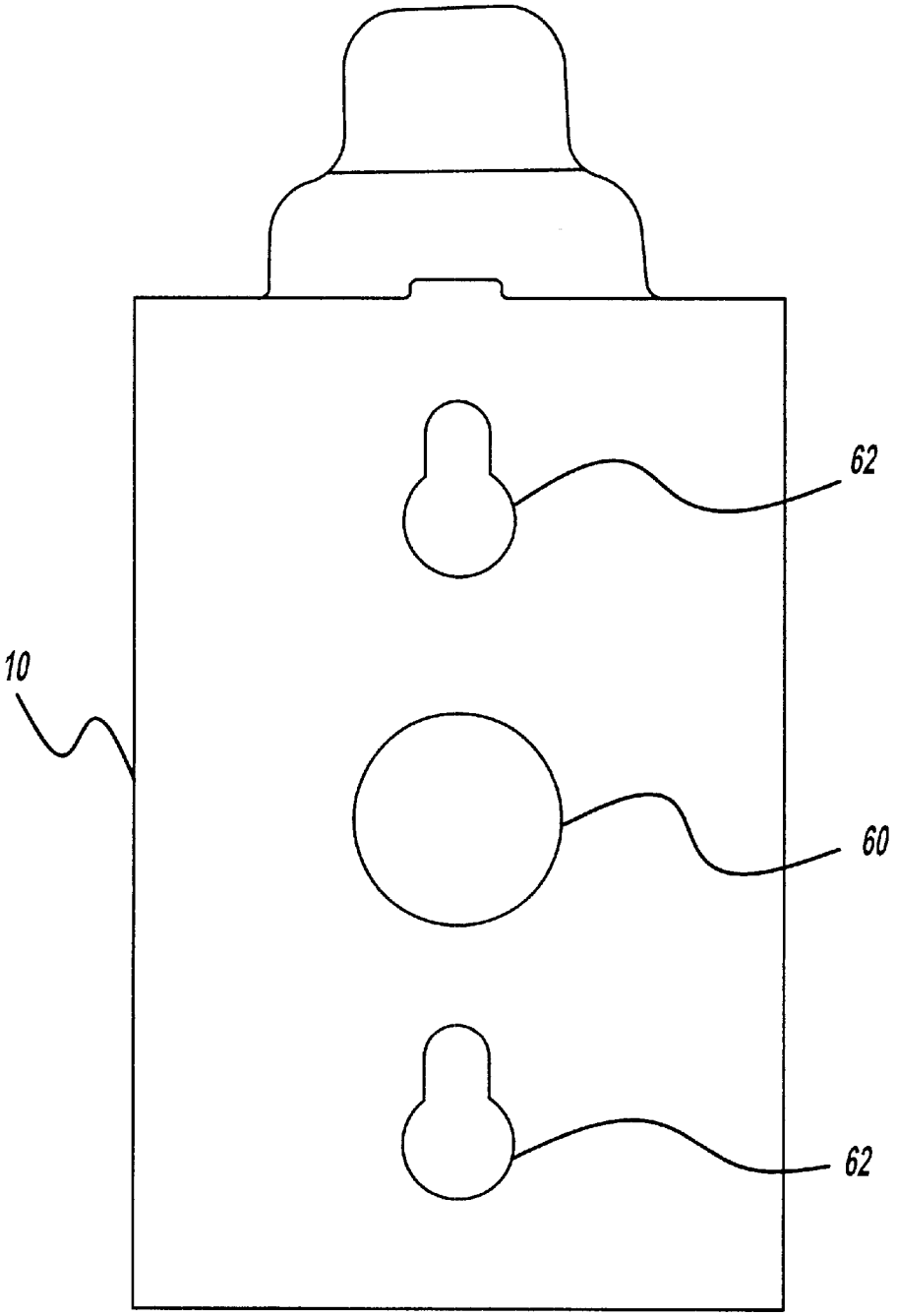
FIG. 4 is a rear elevational view of the mounting arm of FIG. 1.

Referring now to FIG. 4 in the drawings, there is further illustrated an aperture 60 through which electrical service wires such as the electrical supply wiring set 61 may enter and exit mounting arm 10. Aperture 60 may be of any shape and size an required by the amount and relative size of the electrical service wires that must be placed through the aperture. Mounting arm 10 may also be provided with one or more keyhole mounting slots 62 for affixing the same to a stanchion such as a pole, wall, or any suitable desired mounting surface. The keyhole mounting slots are used in combination with some form of fastening means (not shown) to connect the mounting arm 10 to the stanchion or wall. More specifically, recesses screws (not shown) may used and placed through the keyhole mounting slots 62 and subsequently fastened into the mounting wall or stanchion. In another form of attachment, the mounting wall or stanchion may have extending screws or fasteners (not shown) of some form that would extend through the keyhole mounting slots 62. Nuts or caps or some fashion would cooperate with the screws or fasteners to attach and support the mounting arm 10 to the stanchion or mounting wall.

Figure 3:
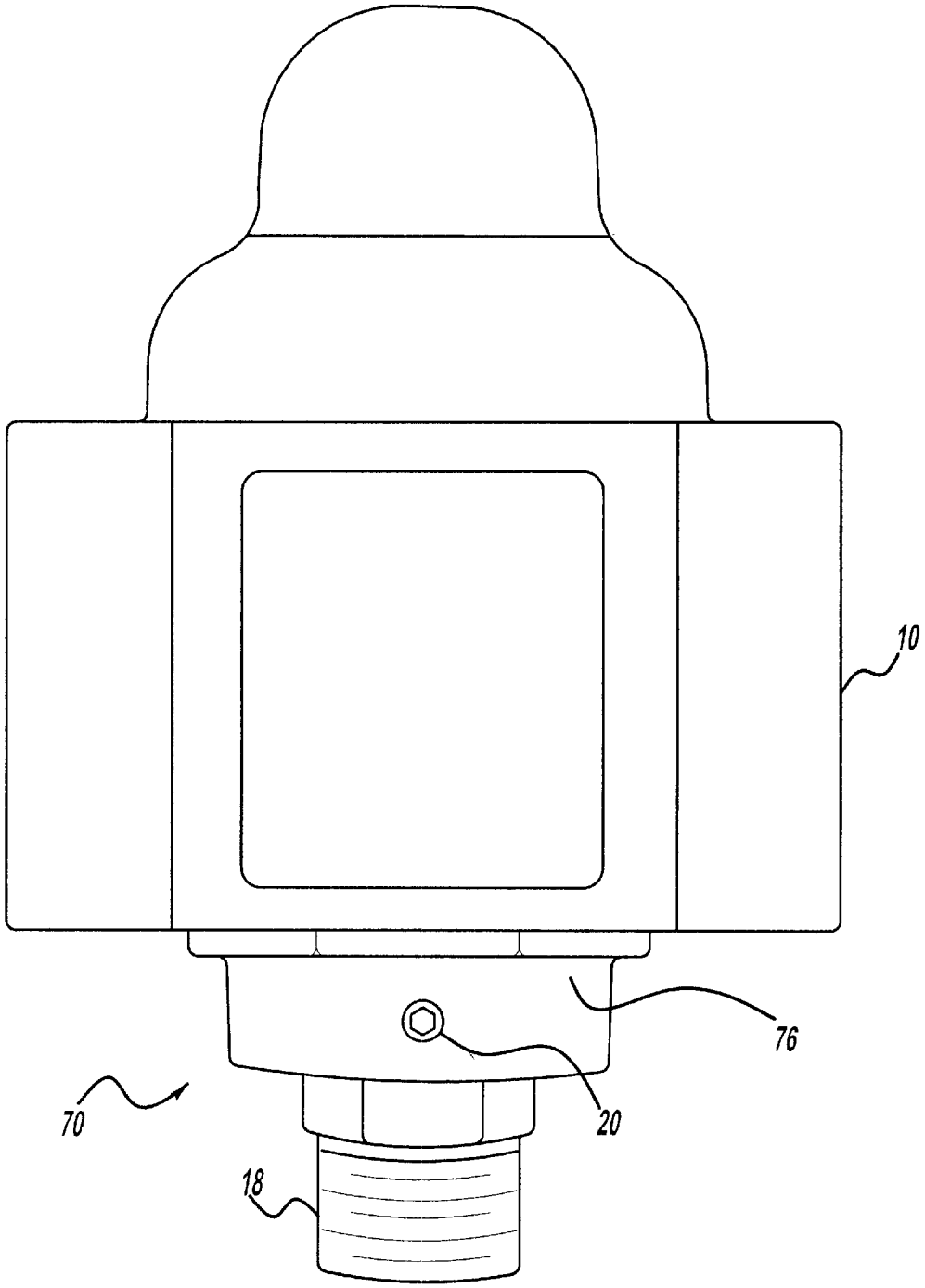
FIG. 3 is a front elevational view of the mounting arm of FIG. 1.

As shown in FIG. 3, mounting arm assembly 10 includes the optical mounting assembly 70. As shown more specifically in FIG. 5, modular mounting-arm assembly 10 has extending therefrom an optical mounting assembly 70. Optical mounting assembly 70 includes a bottom plate 76 attached to mounting arm assembly 10 with three screws 79. Bottom plate 76 has a hole through which swivel nipple assembly 18 is inserted. Swivel nipple assembly 18 includes pipe threads, which extend below bottom plate 76. The optical assembly (not shown) attached to the pipe threads. Swivel nipple assembly 18 rotates within bottom plate 76 and can be leveled. Once the optical assembly (not shown) is level the set screws 20 are tightened and the optical assembly is locked in place.

Figure 5:
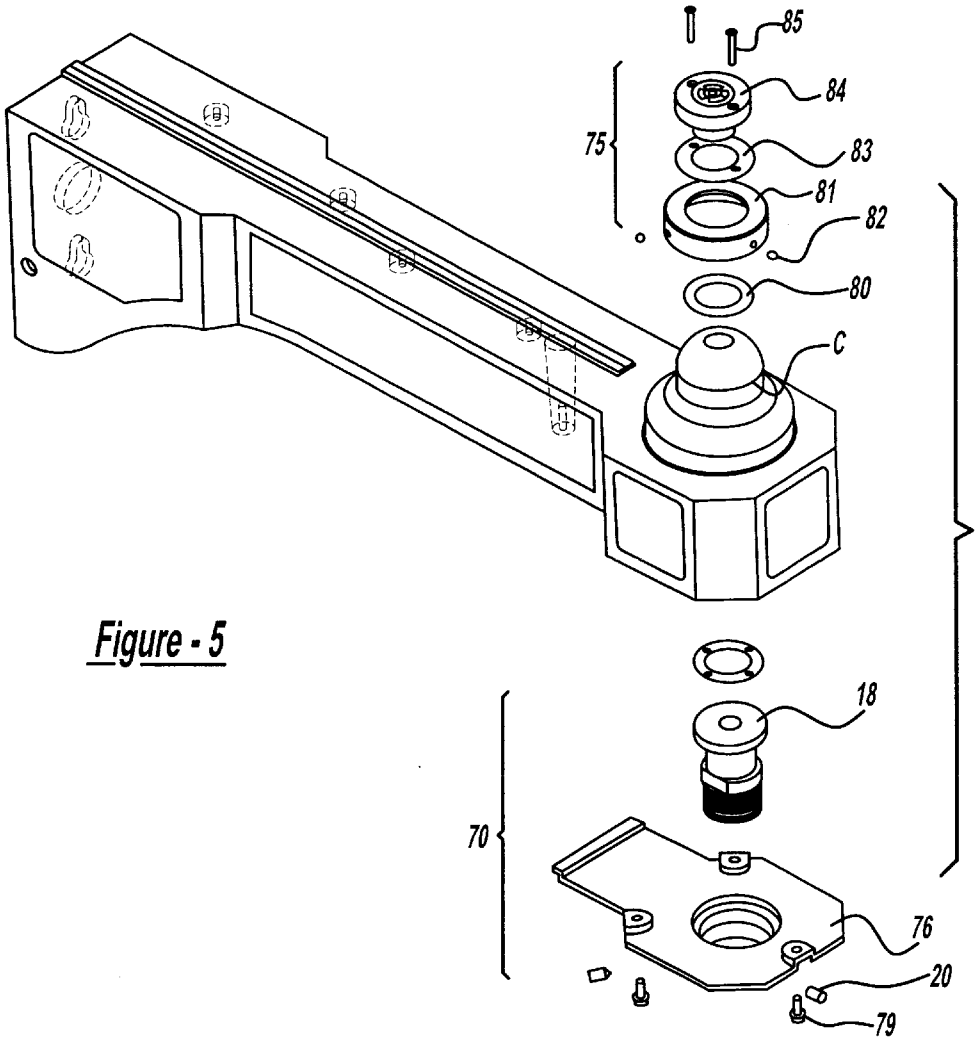
FIG. 5 is a perspective, partially exploded view of the modular mounting arm assembly of the present invention.

Still referring to FIG. 5, mounting arm assembly 10 illustrates an optional photocontrol receptacle assembly 75. The top decorative dome on mounting arm assembly 10 may be cut off at cutline C to accommodate optional photocontrol receptacle assembly 75. Photocontrol receptacle assembly 75 consists of a mounting ring 80, attachment ring 81, set screws 82, gasket 83, receptacle 84 and screws 85. Optional photocontrol receptacle assembly 75 is placed over cut off dome on the mounting arm assembly 10 and the assembly may be rotated within 360 degrees of rotation and may be locked in place by tightening the set screws 82.

The optical mounting assembly 70 incorporates the swivel assembly 18 and allows for a leveling action of the optical assembly 15 in a range from 0 to 5 degrees. In the preferred embodiment the leveling action is in a range from 0 to 3.5 degrees. In operation the optical assembly 15 may be connected to the mounting arm 10. The optical assembly is then leveled in reference to the environment such that it is movable in a range from 0 to 5 degrees of the plane x of the mounting arm 10. Once the appropriate position is reached, the set screws 20 are tightened such that the optical assembly 15 is fastened in place.

The above described degree of leveling is also in a 360 degree plane as the swivel assembly is completely rotatable. More specifically, the swivel assembly 18 allows the optical assembly 15 to be fully rotatable within a 360 degree range of motion. Thus the swivel assembly 18 rotatability in combination with the leveling action afford the optical assembly with a complete range of motion which is extremely useful in the initial hanging or placement of the luminaire. Further, in routine maintenance operations with the access door is removed and the electrical assembly repaired or replaced, it may also be appropriate to realign or adjust the current positioning of the optical unit. In this instance, the present invention including the swivel assembly 15, not only affords quick maintenance of the electrical components but also a simple readjustment or realignment of the optical assembly of the luminaire.

The present invention further contemplates a complete luminaire assembly 80 for outdoor lighting comprising a optical assembly 15 and a modular mounting-arm assembly 10 affixable to the optical assembly 15 with a removable access door 12 as described above. The complete luminaire assembly 80 provides a modular electrical assembly 26. This modularity provides for flexibility in designing an ornamental mounting arm 10 for a luminaire which permits system components to be readily repaired, replaced or adjusted on site with simplicity and efficiency. The access door 12 including the electrical components such as the starter 28, capacitor 30, ballast 32, and an electrical disconnect 34 can be seen as a subassembly containing electrical components for use with the luminaire assembly.

The access door with the electrical components can be easily modified to accept new components inexpensively and quickly without affecting any other part of the lighting system. This in turn allows creation of the most efficient number and type of subassemblies which affords greater flexibility in design of the entire luminaire system. Flexibility is important in the current design of ornamental light equipment due to the desire for interchangeability of various components. Replacement of access doors 12 including modified or different electrical assemblies is an advantage of the present invention. If for instance, a new optical unit is desired with a different lighting capacity, different electrical components may be required. According to the present invention, different electrical assemblies, affixed to the access door can be added to the luminaire in a simple fashion. The previous access door 12 is removed and the new or modified access door including the new electrical assembly that corresponds with the new optical unit is provided. The use of the compact and efficient design of the mounting arm 10 of the present invention in combination with the interchangeability of the electrical components is of great importance to current luminaire designers.

In addition, as discussed above, optical units or assemblies are known to those skilled in the art to require routine repair, replacement or maintenance. For example, it is known that lighting units often must be replaced when the surfaces are penetrated by foreign substances or when they have been fractured as a result of whether conditions or tampering. Repair, replacement or maintenance of the lighting unit often requires a review or repair replacement or maintenance of the attendant electrical assemblies or components. The repair technicians ability to swing out the access door 12 for a quick review is very useful as the access door is still connected to the mounting arm housing 13 but still allows for complete view of the electrical assembly 26. If electrical components such as the starter 28, capacitor 30, ballast 32, and an electrical disconnect 34 need repair or replacement, the access door 12 can be easily removed. The repair or replacement can then be done at the repair vehicle, in the ground or at a remote location as the situation requires.

As discussed above, U.S. Pat. No. 5,243,508 to Holophane Company, Inc. discloses a modular luminaire assembly for receiving assorted optical assemblies and assorted electrical assemblies. The modular luminaire assembly includes a base unit having an opening on one side and a platform for receiving and supporting a selected optical assembly and a removable panel assembly mountable within the opening. The panel assembly is adapted to received and support a selected electrical assembly. The base unit, optical assembly and panel assembly form respective first, second, and third unitary modules.

The present invention improves upon the luminaire if the U.S. Pat. No. 5,243,508 by providing the mounting arm 10 with the electrical assembly 26. The mounting arm 10 is significantly smaller in relative size than the base unit of the prior art and operates in a different manner. Mounting arm 10 further affords the luminaire designer the ability to move the lighting or optical unit 15 out away from the stanchion or wall mount without additional connections. Mounting arm 10 includes a rectangular shaped mounting arm housing 13 which is substantially elongate in shape.

In addition, access door is hingedly connected to mounting arm housing 13. This hinged connection, as discussed above allows for a swinging open of the access door 12 from the mounting arm housing 13. As noted above, the repair technicians ability to swing out the access door 12 for a quick review is very useful as the access door is still connected to the mounting arm housing 13 but still allows for complete view of the electrical assembly 26. If actual repair or replacement is needed, the access door is completely removable as discusses above.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. In a mounting arm assembly adapted for connection to a support and mounting an optical assembly for providing illumination, the optical assembly being energized by a source of power through an electrical assembly mounted within the mounting arm assembly, the mounting arm assembly comprising:

a housing within which the electrical assembly is contained;

an access door mounted to the housing and movable between open and closed positions to allow access to the interior of the housing and to close the housing to prevent exposure of the interior of said housing and the electrical assembly contained therein to environmental conditions, the access door being removable from the housing and the electrical assembly being mounted to the access door;

means for mounting the access door to the housing for removal from said housing; and, electrical disconnect means carried by the electrical assembly or the mounting arm assembly for disconnection of the electrical assembly from the source of power and from the optical assembly, thereby enabling rapid removal of the access door from the housing, said access door bearing said electrical assembly, thereby allowing ready for maintenance or replacement of a substitute access door and electrical assembly mounted thereto.

2. In the mounting arm assembly of claim 1 and further comprising means for mounting the electrical assembly for rapid detachment as a unitary assemblage to a portion of the access door to allow access to the electrical assembly when the access door is in an open position and to position the electrical assembly within the interior of the housing on closure of the access door, the electrical assembly being removable from the housing on removal of the access door from the housing.

3. In the mounting arm assembly of claim 1 and further comprising leveling means carried by the mounting arm assembly for adjusting the position of the optical assembly.

4. In the mounting arm assembly of claim 3 wherein adjustment of the position of the optical assembly is in a plane taken through the optical assembly.

5. In the mounting arm assembly of claim 3 wherein the leveling means comprise a swivel assembly to which the optical assembly is mounted, the swivel assembly being rotatable in a 360° plane for leveling the optical assembly within said plane.

6. In the mounting arm assembly of claim 1 wherein the access door is hingedly affixable to the housing.

7. In the mounting arm assembly of claim 1 wherein the electrical assembly comprises electrical components having electrical connections mateable with the electrical disconnect means to permit rapid disconnection of the electrical assembly from the source of power and from the optical assembly.

8. In the mounting arm assembly of claim 1 wherein the electrical components comprise a ballast, a starter and a capacitor.

9. In the mounting arm assembly of claim 1 wherein the access door in combination with other portions of the mounting arm assembly defines a sealed internal cavity within the housing when in a closed position such that said sealed internal cavity protects said electrical assembly from detrimental environmental conditions.

10. In the mounting arm assembly of claim 1 wherein said housing includes an aperture for receiving an electrical supply wiring set for connection between the electrical assembly and the source of power.

11. In the mounting arm assembly of claim 10 and further comprising a housing quick disconnect means carried by the housing and connectible to the electrical supply wiring set for quick disconnection therefrom.

12. In a mounting arm assembly adapted for connection to a support and mounting an optical assembly for providing illumination, the optical assembly being energized by a source of power through an electrical assembly mounted within the mounting arm assembly, the mounting arm assembly comprising:

a housing within which the electrical assembly is contained;

an access door mounted to the housing and movable between open and closed positions to allow access to the interior of the housing and to close the housing to prevent exposure of the interior of the housing and the electrical assembly contained therein to environmental conditions, the access door being removable from the housing on the electrical assembly being mounted to the access door;

electrical disconnect means carried by the electrical assembly or the arm assembly for rapid disconnection of the electrical assembly from the source of power and from the optical assembly to enable rapid removal of the access door from the housing, said access door bearing said electrical assembly thereby allowing maintenance or replacement of a substitute access door and electrical assembly mounted thereo; and, leveling means carried by the mounting arm assembly for adjusting the position of the optical assembly.

13. In the mounting arm assembly of claim 12 and further comprising means for mounting the electrical assembly for rapid detachment to a portion of the access door to allow access to the electrical assembly when the access door is in an open position and to position the electrical assembly within the interior of the housing on closure of the access door, the electrical assembly being removable from the housing on removal of the access door from the housing.

14. In the mounting arm assembly of claim 12 wherein adjustment of the position of the optical assembly is in a plane taken through the optical assembly.

15. In the mounting arm assembly of claim 12 wherein the leveling means comprise a swivel assembly to which the optical assembly is mounted, the swivel assembly being rotatable in a 360° plane for leveling the optical assembly within said plane.

16. In the mounting arm assembly of claim 12 and further comprising means for affixing the optical assembly in place after leveling.

* * * * *